US006527219B1

(12) United States Patent
Trecartin

(10) Patent No.: US 6,527,219 B1
(45) Date of Patent: Mar. 4, 2003

(54) TOILET PAPER DISPENSING SYSTEM

(76) Inventor: James A. Trecartin, 1413 W. Hidden Crest Ct., Green Valley, AZ (US) 85614

( * ) Notice: Subject to any disclaimer, the term of this patent is extended or adjusted under 35 U.S.C. 154(b) by 0 days.

(21) Appl. No.: 10/138,948

(22) Filed: May 3, 2002

Related U.S. Application Data

(63) Continuation-in-part of application No. 10/078,566, filed on Feb. 15, 2002, now Pat. No. 6,405,971.

(51) Int. Cl.[7] ..... B65H 16/02; B65H 16/06
(52) U.S. Cl. ..... 242/592; 242/598
(58) Field of Search ..... 242/591, 592, 242/598, 598.5

(56) References Cited

U.S. PATENT DOCUMENTS

| | | | | |
|---|---|---|---|---|
| 2,459,252 | A | 1/1949 | Strahan | |
| 4,422,585 | A | 12/1983 | Schultz et al. | |
| 4,696,582 | A | 9/1987 | Kasten | 384/18 |
| 4,741,486 | A | 5/1988 | Ancona et al. | |
| 5,868,345 | A | 2/1999 | Beisser | 242/592 |
| 5,871,170 | A | 2/1999 | Morales et al. | 242/592 |
| 5,967,452 | A | 10/1999 | Wilder | 242/597.4 |
| 6,126,108 | A | 10/2000 | Bush | 242/588.2 |
| 6,405,971 | B1 * | 6/2002 | Trecartin | 242/592 |

* cited by examiner

*Primary Examiner*—William A. Rivera

(57) ABSTRACT

An improved toilet paper dispensing system for providing easy access to a roll of toilet paper. The toilet paper dispensing system includes a base member, one or more spacer members attachable to the base member, a telescoping structure attachable to the spacer members, a cover member attached to telescoping structure, a handle member attached to the cover member, and a toilet paper holder attached to the cover member. The telescoping structure is comprised of a plurality of members slidably connected to one another, sliding longitudinally, guided by a plurality of upper and lower ball bearings in rolling engagement with the telescoping members. The spacer members and base member reposition the telescoping plane of the telescoping structure so as to prevent engagement with obstructions such as a perimeter ridge on a cabinet.

20 Claims, 6 Drawing Sheets

TOILET PAPER DISPENSING SYSTEM

CROSS-REFERENCE TO RELATED U.S. PATENT APPLICATION

I hereby claim benefit under Title 35, United States Code, Section 120 of U.S. patent application Ser. No. 10/078,566 filed Feb. 15, 2002 now U.S. Pat. No. 6,405,971. This application is a continuation-in-part of the U.S. Ser. No. 10/078,566 application. The Ser. No. 10/078,566 application is currently pending. The U.S. Ser. No. 10/078,566 application is hereby incorporated by reference into this application.

CROSS REFERENCE TO DISCLOSURE DOCUMENT

A Disclosure Document was filed with the Disclosure Document Program on Dec. 3, 2001 and identified by Disclosure Document No. 503,634. The present application hereby incorporates by reference the information contained within Disclosure Document No. 503,634.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to toilet paper holders and more specifically it relates to a toilet paper dispensing system for providing easy access to a roll of toilet paper.

2. Description of the Prior Art

Toilet paper holders have been in use for years. Typically, a conventional toilet paper holder is comprised of a U-shaped bracket or duel post structure attachable to a wall or cabinet with a spring-loaded telescoping member extending between the opposing forks thereof for rotatably supporting a roll of toilet paper.

A problem with toilet paper holders in general is that their location is dictated by bathroom and cabinet design. Due to the limitations inherent in many such designs, a conventional toilet paper holder is often, by necessity, placed in a position where it is difficult to access by persons positioned upon a toilet; requiring an undue, and often painful, twisting and turning.

The toilet paper dispensing system according to the present invention is substantially different from conventional concepts, and distinguished from designs of prior art in functionality, ease of access to toilet paper, and aesthetic import.

Examples of patented devices which are related to the present invention include U.S. Pat. No. 5,868,345 to Beisser; U.S. Pat. No. 4,696,582 to Kasten; U.S. Pat. No. 2,459,252 to Strahan; U.S. Pat. No. 4,422,585 to Schultz et al.; U.S. Pat. No. 5,967,452 to Wilder; U.S. Pat. No. 5,971,170 to Morales et al.

While these devices may be suitable for the particular purpose to which they address, they are not as suitable for providing easy access to a roll of toilet paper. Conventional toilet paper dispensing devices do not provide easy access to a roll of toilet paper.

In these respects, the toilet paper dispensing system according to the present invention substantially departs from the conventional concepts and designs of the prior art, and in so doing provides an apparatus primarily developed for the purpose of providing easy access to a roll of toilet paper.

SUMMARY OF THE INVENTION

The object of the present invention, which will be described subsequently in greater detail, is to provide a new and improved toilet paper dispensing system with novel features that result in a new toilet paper dispensing system which is not anticipated, rendered obvious, suggested, or even implied by any of the prior art toilet paper holders, either alone or in any combination thereof.

To attain this, the present invention generally comprises a base member, one or more spacer members attachable to the base member, a telescoping structure attachable to the spacer members, a cover member attached to telescoping structure, a handle member attached to the cover member, and a toilet paper holder attached to the cover member. The telescoping structure is comprised of a plurality of members slidably connected to one another, sliding longitudinally, guided by a plurality of upper and lower ball bearings in rolling engagement with the telescoping members. The spacer members and base member reposition the telescoping plane of the telescoping structure so as to prevent engagement with obstructions such as a perimeter ridge on a cabinet.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a toilet paper dispensing system that will overcome the shortcomings of the prior art devices.

A further object is to provide a telescoping toilet paper dispensing system that provides easy access to individuals with physical disabilities such as chronic back pain making twisting and turning difficult and painful.

Another object is to provide a toilet paper dispensing system that is aesthetically pleasing.

Another object is to provide a toilet paper dispensing system with strength and smoothness of movement.

A further object is to provide a toilet paper dispensing system that may be adjusted to accommodate various cabinet and wall structures.

Another object is to provide a toilet paper dispensing system that may be attached to various structures such as but not limited to walls, cabinets and the like.

An additional object is to provide a toilet paper dispensing system that does not interfere with the normal operation of a bathroom.

A further object is to provide a toilet paper dispensing system that is extendible a sufficient distance to provide easy access to a roll of toilet paper.

A further object is to provide a cover member sufficient in length to cover said telescoping toilet paper dispensing structure in a contracted position so as to be a pleasingly attractive bathroom artifact.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
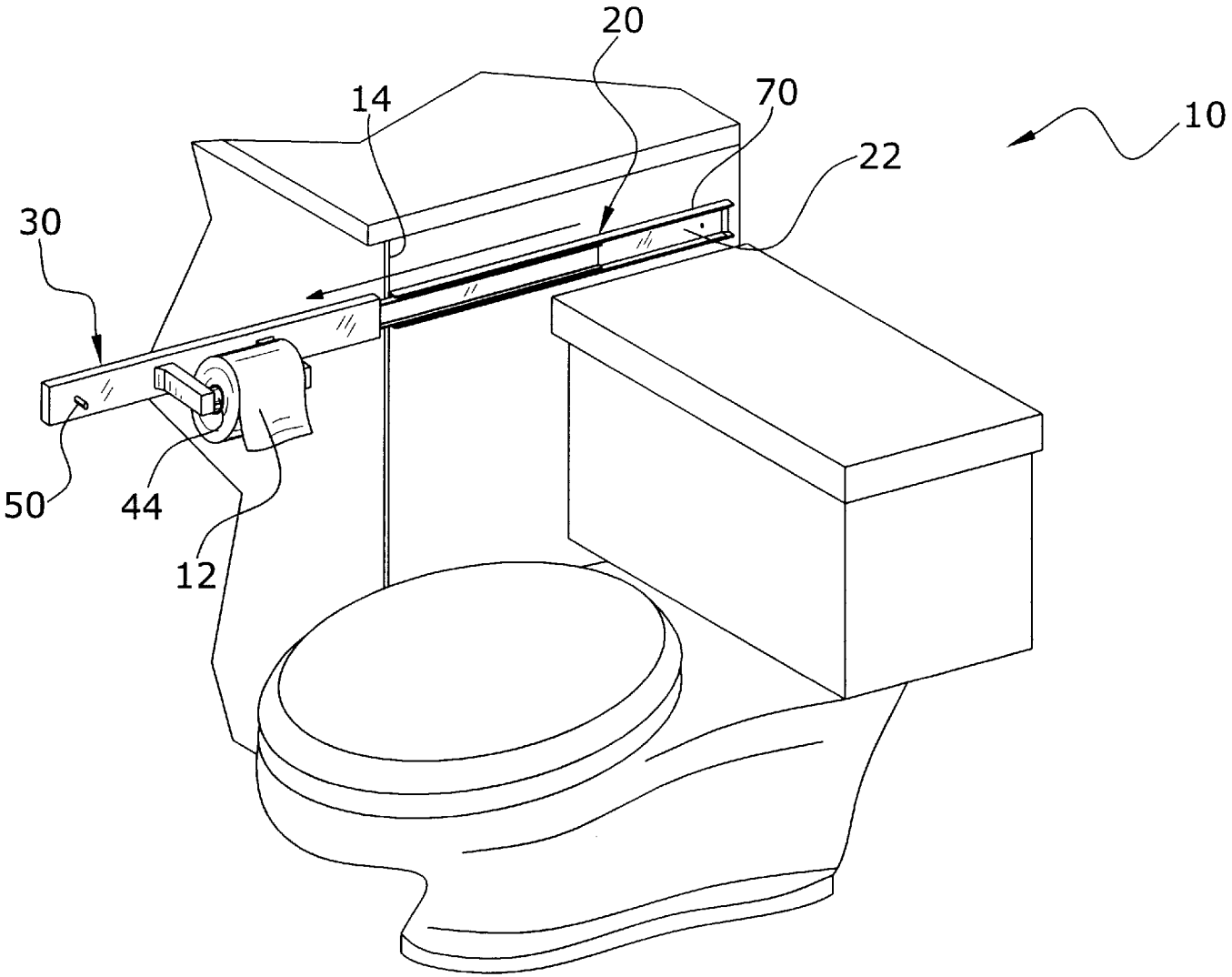
FIG. 1 is an upper perspective view of the present invention in an extended position from a cabinet.

Turning now descriptively to the drawings, in which similar reference characters denote similar elements throughout the several views, FIGS. 1 through 6 illustrate a toilet paper dispensing system 10, which comprises a base member 70, one or more spacer members 60 attachable to the base member 70, a telescoping structure 20 attachable to the spacer members 60, a cover member 30 attached to telescoping structure 20, a handle member 50 attached to the cover member 30, and a toilet paper holder attached to the cover member 30. The telescoping structure 20 is comprised of a plurality of members slidably connected to one another. The spacer members 60 and base member 70 reposition the telescoping plane of the telescoping structure 20 so as to prevent engagement with obstructions such as a perimeter ridge on a cabinet.

Figure 3:
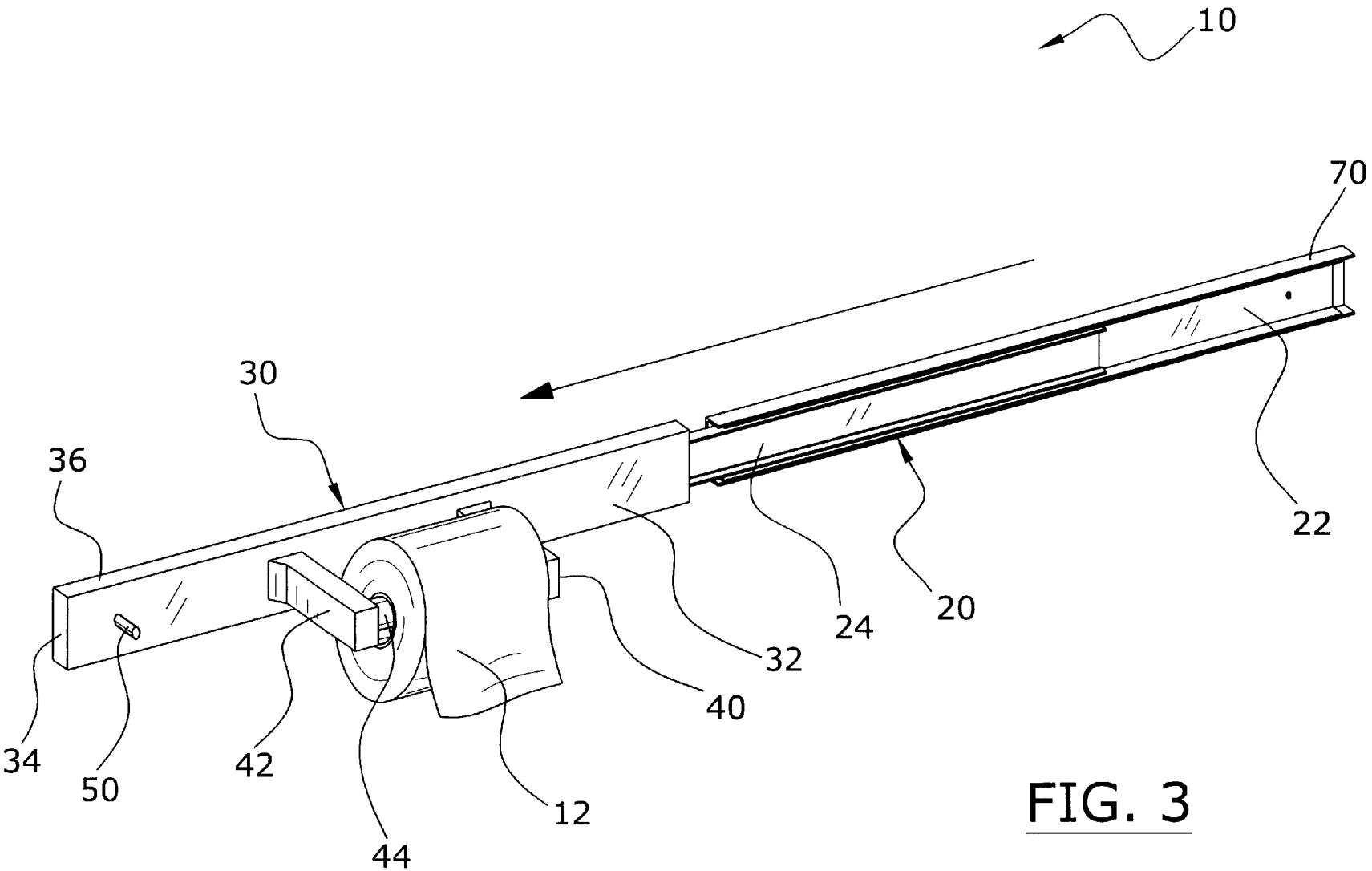
FIG. 3 is an upper perspective view of the present invention in the extended position.
Figure 4:
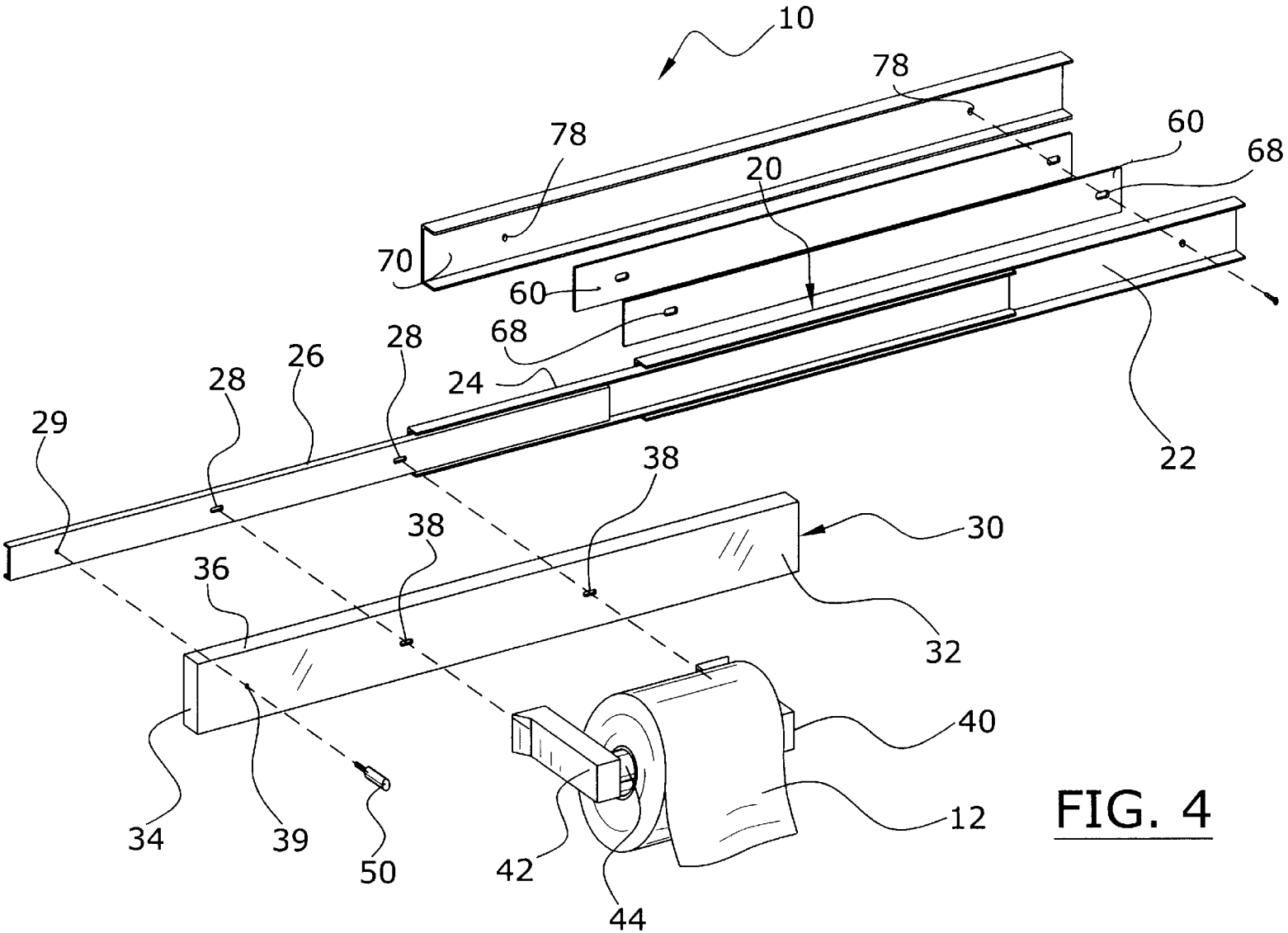
FIG. 4 is an exploded view of the present invention.
Figure 5:
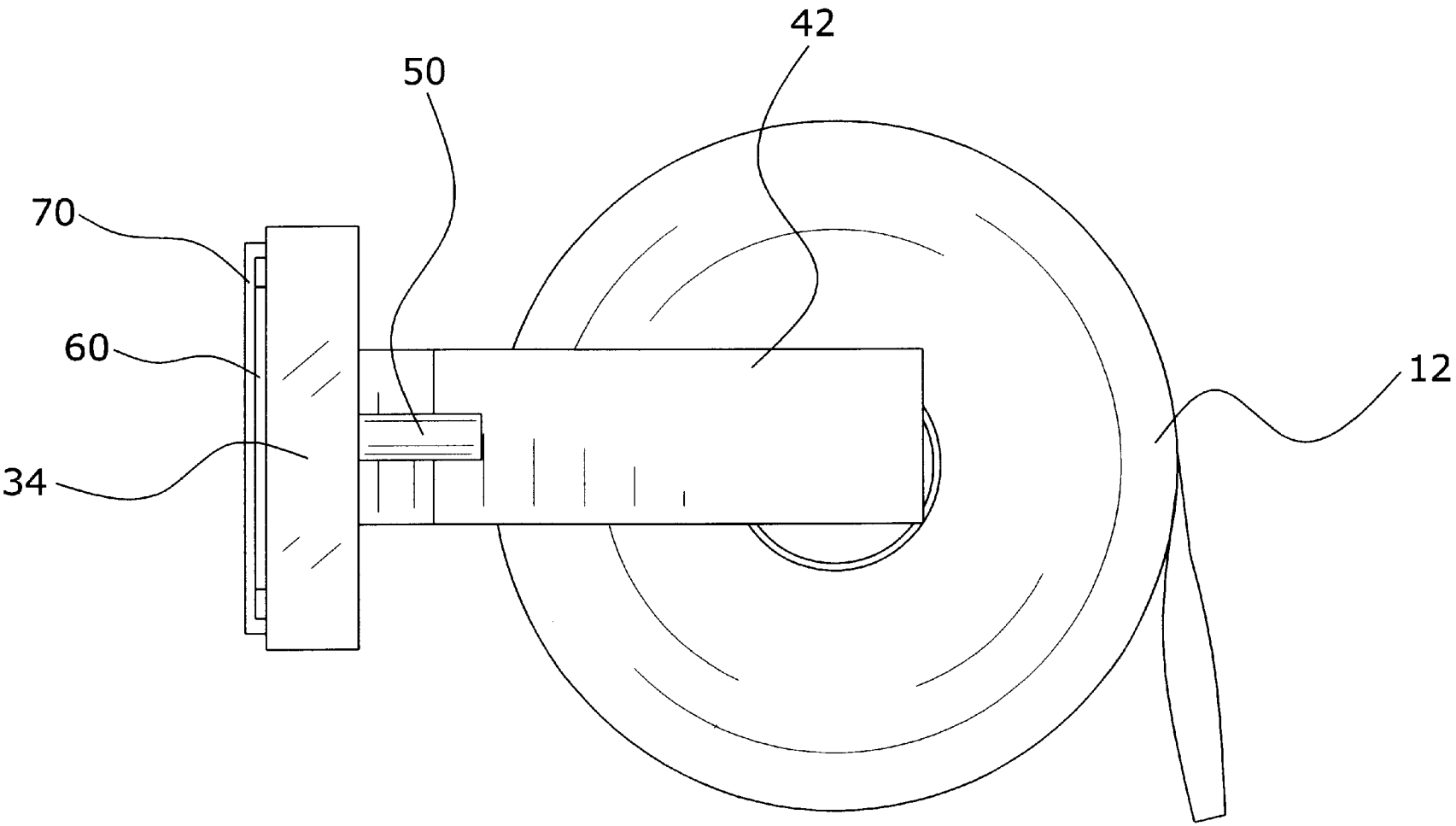
FIG. 5 is a cross sectional view along line 5—5 of FIG. 2 illustrating the distal end view of the present invention.

As shown in FIGS. 1, 3 and 4 of the drawings, the telescoping structure 20 is comprised of a plurality of members capable of having various lengths and sizes. The telescoping structure 20 is preferably comprised of a ball bearing slide such as the 4600 SERIES FULL EXTENSION BALL BEARING SLIDE manufactured by DYNASLIDE. The telescoping structure 20 may also be constructed of a plurality of members slidably connected to one another without the usage of a ball bearing structure.

As shown in FIG. 4 of the drawings, the telescoping structure 20 is preferably comprised of a first member 22, a second member 24 slidably connected to the first member 22, and a third member 26 slidably connected to the second member 24. The members 22, 24, 26 are preferably connected so as to prevent accidental removal of the members 22, 24, 26 from one another during extension thereof. As shown in FIG. 4 of the drawings, the members 22, 24, 26 may each be comprised of U-shaped cross sectional structure with the first member 22 and the second member 24 facing outwardly and the third member 26 facing inwardly as shown in FIG. 4 of the drawings.

The first member 22 is attached to a structure such as a wall or cabinet by a plurality of fasteners or other well-known fastening means. One or more spacer members 60 may be positioned between the first member 22 and the structure to prevent the telescoping structure 20 from engaging an obstruction such as a perimeter ridge upon a cabinet as shown in FIG. 1 of the drawings. The spacer members 60 have an elongate structure as shown in FIG. 4 of the drawings. The spacer members 60 may have varying thickness depending upon the desired extension of the telescoping structure 20 from the structure. Any desired number of spacer members 60 may be utilized to achieve the desired distance of the telescoping structure 20 from the cabinet. The spacer members 60 preferably include one or more spacer apertures 68 that correspond to apertures within the first member 22 of the telescoping structure 20 for receiving the unnumbered fasteners.

Figure 6:
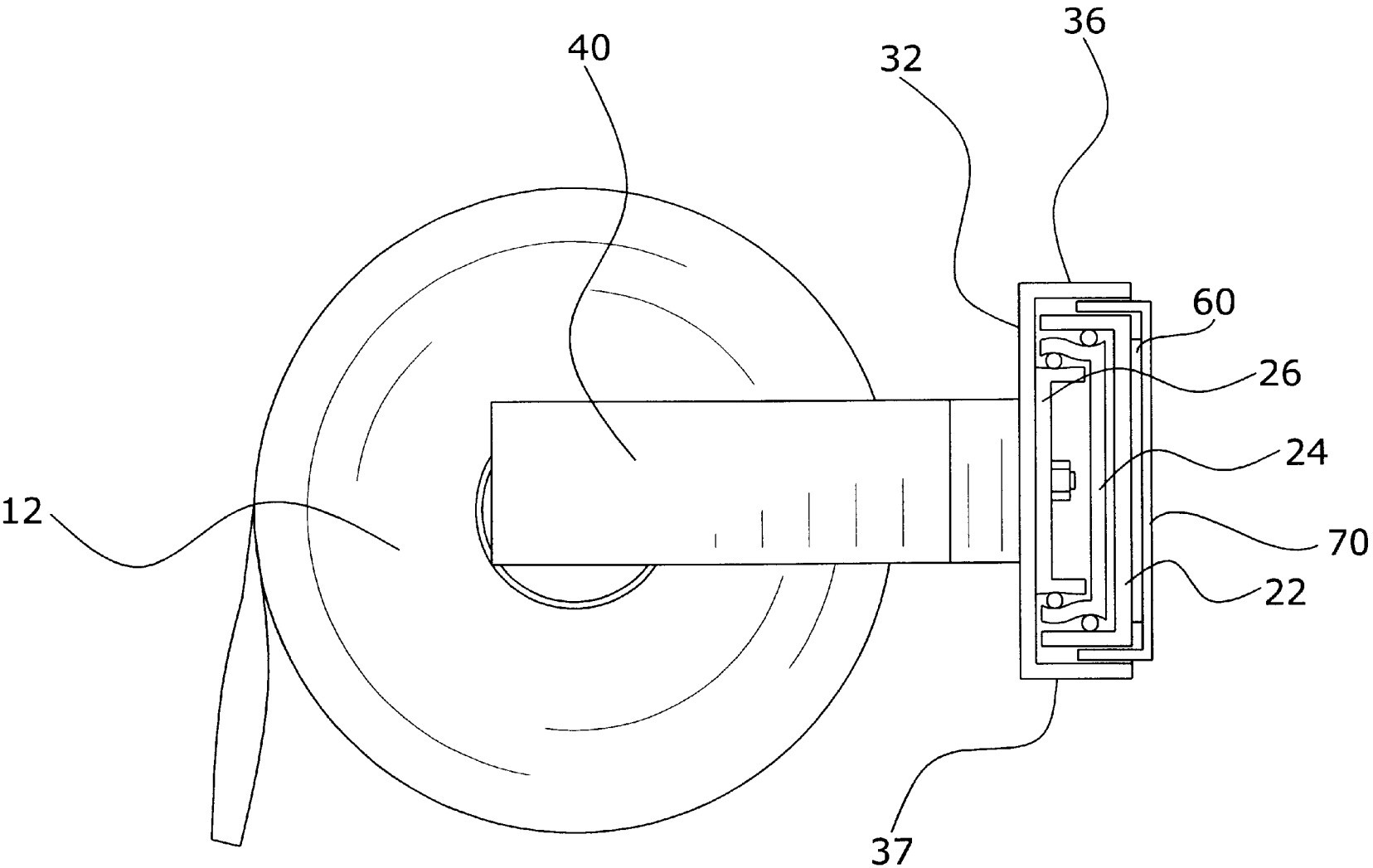
FIG. 6 is a cross sectional view taken along line 6—6 of FIG. 2 illustrating the inner end view of the present invention.

As further shown in FIGS. 3, 4 and 6 of the drawings, a base member 70 may be attached between the spacer members 60 and the structure such as a cabinet. The base member 70 preferably has a U-shaped cross sectional shape with a receiver channel for receiving the spacer members 60 within. The base member 70 further preferably includes one or more base apertures 78 for receiving the unnumbered fasteners extending through the corresponding spacer apertures 68 of the spacer members 60.

As further shown in FIG. 4 of the drawings, the third member 26 has a pair of first rear apertures 28. The pair of first rear apertures 28 are each preferably an elongated slotted structure for receiving various sizes and styles of toilet paper holders other than that shown in the drawings. A second rear aperture 29 extends through the distal portion of the third member 26 for receiving the handle member 50 as shown in FIG. 4.

Figure 2:
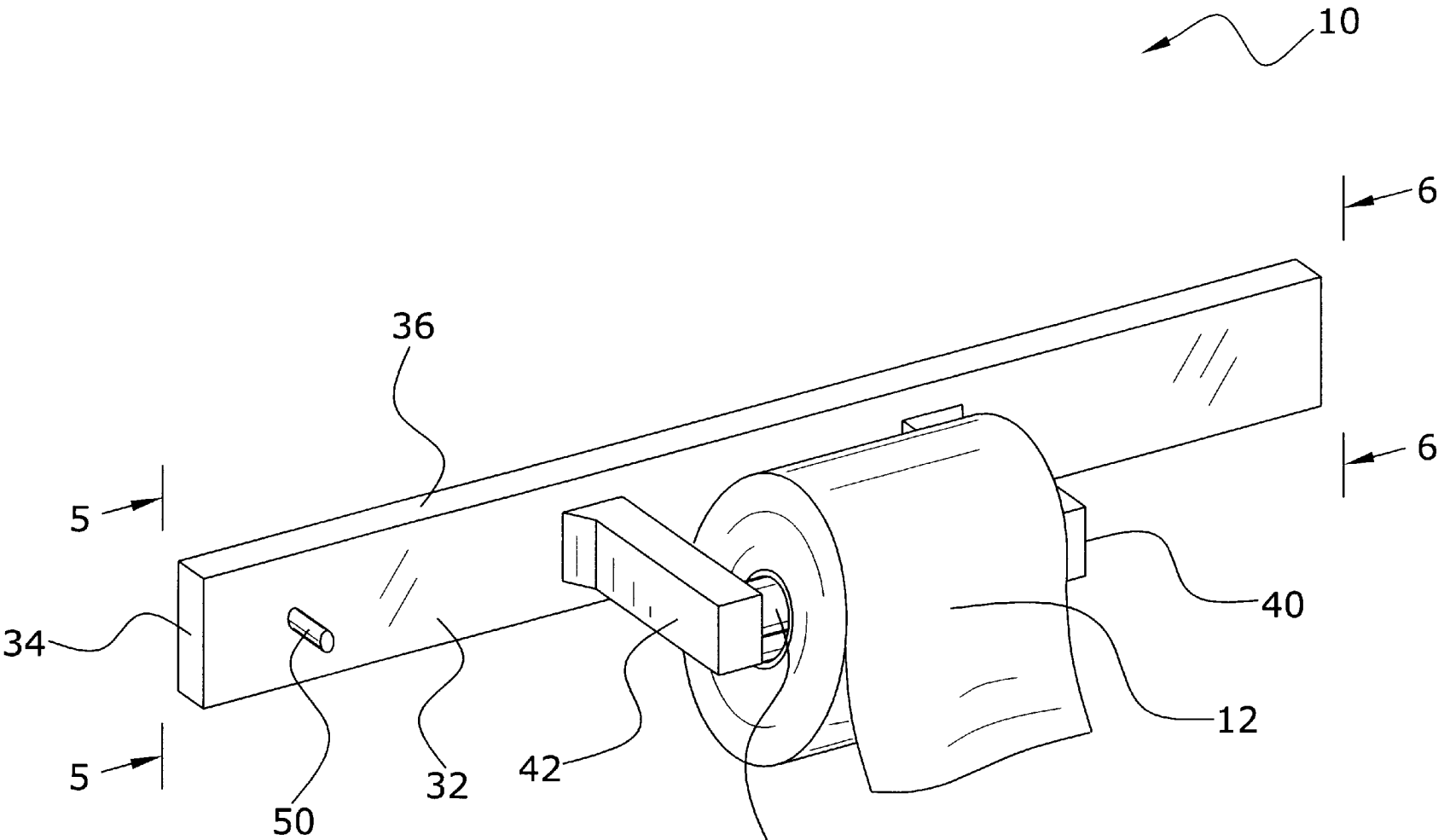
FIG. 2 is an upper perspective view of the present invention in a contracted position.

As shown in FIGS. 1 through 6 of the drawings, a cover member 30 is attached to the third member 26 and slidably positionable over the entire telescoping structure 20 for covering the telescoping structure 20 from view when contracted. The telescoping structure 20 has a U-shaped cross-sectional area as best illustrated in FIG. 6 of the drawings. The cover member 30 is comprised of a front portion 32, an upper edge 36, a lower edge 37, an end portion 34 and an open portion opposite of the end portion 34. The cover member 30 has a pair of first front apertures 38 that correspond to the first rear apertures 28. The cover member 30 further includes a second front aperture 39 that corresponds to the second rear aperture 29. The cover member 30 has an elongate structure sufficient to enclose the telescoping structure 20 when in the contracted position as shown in FIG. 2 of the drawings.

As shown in FIGS. 1 through 6 of the drawings, the toilet paper holder is attached to the cover member 30 and the third member 26 by conventional fasteners extending through the first apertures 28, 38. The toilet paper holder illustrated within the drawings is comprised of a first arm 40, a second arm 42 and a support member 44 removably positioned between the arms 40, 42 for supporting a roll of toilet paper 12. It is also anticipated that mounting brackets or similar structure may be utilized for securing the toilet paper holder to the cover member 30 and the third member 26. However, it can be appreciated that various other types of toilet paper holders may be attached to the cover member 30. The first rear apertures 28 may be interiorly threaded for threadably receiving the fasteners or a mounting nut may be utilized to secure the fasteners within the first rear apertures 28.

As further shown in FIGS. 1 through 5 of the drawings, a handle member 50 is attached to the cover member 30. The handle member 50 preferably has a threaded distal end that is threadably secured within the second rear aperture 29 within the third member 26 thereby assisting in the securing of the cover member 30 to the third member 26. The handle member 50 may be directly attached to the cover member 30 via conventional securing means other than threaded attachment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet paper dispensing system, comprising:

a telescoping structure having at least a base portion and a distal portion slidably connected to one another;

at least one spacer member attachable to said base portion;

a cover member attached to said distal member; and a toilet paper holder attached to said cover member.

2. The toilet paper dispensing system of claim 1, wherein said cover member is comprised of an elongate structure sufficient in length to cover said telescoping structure in a contracted position.

3. The toilet paper dispensing system of claim 1, wherein said cover member is comprised of a front portion, an end portion, a pair of opposing edge portions and an open end portion.

4. The toilet paper dispensing system of claim 1, wherein said cover member includes a pair of first apertures that receive fasteners for securing said toilet paper holder to said cover member.

5. The toilet paper dispensing system of claim 4, wherein said distal portion of said telescoping structure has a pair of first rear apertures that correspond to said pair of first apertures within said cover member for receiving said fasteners.

6. The toilet paper dispensing system of claim 1, wherein said cover member has a U-shaped cross sectional shape.

7. The toilet paper dispensing system of claim 1, wherein said telescoping structure is comprised of a ball bearing slide structure.

8. The toilet paper dispensing system of claim 1, wherein said telescoping structure includes a middle portion slidably attached to said base portion and slidably supporting said distal portion.

9. The toilet paper dispensing system of claim 8, wherein said base portion and said middle portion have a U-shaped cross sectional shape facing outwardly, and said cover member and said distal portion have a U-shaped cross sectional shape facing inwardly.

10. The toilet paper dispensing system of claim 1, wherein said cover member is comprised of a solid structure.

11. A toilet paper dispensing system, comprising:

a base member;

at least one spacer member attached to said base member;

a telescoping structure having at least a base portion and a distal portion slidably connected to one another, wherein said base portion is attached to said at least one spacer member; and a toilet paper holder attached to said telescoping structure.

12. The toilet paper dispensing system of claim 11, including a cover member comprised of an elongate structure sufficient in length to cover said telescoping structure in a contracted position.

13. The toilet paper dispensing system of claim 11, including a cover member comprised of a front portion, an end portion, a pair of opposing edge portions and an open end portion.

14. The toilet paper dispensing system of claim 11, including a cover member having a pair of first apertures that receive fasteners for securing said toilet paper holder to said cover member.

15. The toilet paper dispensing system of claim 14, wherein said distal portion of said telescoping structure has a pair of first rear apertures that correspond to said pair of first apertures within said cover member for receiving said fasteners.

16. The toilet paper dispensing system of claim 11, including a cover member having a U-shaped cross sectional shape.

17. The toilet paper dispensing system of claim 11, wherein said telescoping structure is comprised of a ball bearing slide structure.

18. The toilet paper dispensing system of claim 11, wherein said telescoping structure includes a middle portion slidably attached to said base portion and slidably supporting said distal portion.

19. The toilet paper dispensing system of claim 18, wherein said base portion and said middle portion have a U-shaped cross sectional shape facing outwardly.

20. The toilet paper dispensing system of claim 11, wherein said spacer members are comprised of an elongated structure.

* * * * *